United States Patent [19]

Sowa et al.

[11] Patent Number: 4,466,651

[45] Date of Patent: Aug. 21, 1984

[54] BLOCK

[76] Inventors: Michael J. Sowa, 865 Gatch St.; Joseph P. Sowa, 449 Marshall St., both of Woodburn, Oreg. 97071

[21] Appl. No.: 300,575

[22] Filed: Sep. 9, 1981

[51] Int. Cl.[3] ..... B66C 1/34

[52] U.S. Cl. ..... 294/82 R

[58] Field of Search ..... 294/74, 78 R, 78 A, 294/82 R, 83 R; 254/392, 401, 409; 267/137, 140.1, 140.3

[56] References Cited

U.S. PATENT DOCUMENTS

| | | | |
|---|---|---|---|
| 2,043,460 | 6/1936 | Young | 294/78 R |
| 2,203,139 | 6/1940 | Grau et al. | 294/82 R |
| 2,513,990 | 7/1950 | Bennett | 294/82 R |
| 2,552,758 | 5/1951 | Andersen | 294/82 R |
| 2,570,320 | 10/1951 | Christensen | 294/82 R X |
| 2,576,261 | 11/1951 | Minor | 294/82 R |
| 2,585,408 | 2/1952 | Roberson | 294/82 R X |
| 2,622,846 | 12/1952 | Bennett | 294/82 R X |
| 3,037,803 | 6/1962 | Phillips | 294/82 R |
| 4,120,189 | 10/1978 | Jones | 294/82 R X |

OTHER PUBLICATIONS

B. J. Hughes, "Hooks and Links", pp. 12–15, Prior Art.
Joy Manufacturing Co., "Joy Oil Tools–Hydra–Hooks", 4 pp., Prior Art.

*Primary Examiner*—Johnny D. Cherry
*Attorney, Agent, or Firm*—Klarquist, Sparkman, Campbell, Leigh & Whinston

[57] ABSTRACT

The present invention is a block including a hollow housing within which a cylindrical container is loosely received and retained against axial motion relative to the housing. A hook supporting shaft is inserted within this container and the shaft is axially slidable relative to the container within predetermined limits. A shock absorbing mechanism within the container dampens the sliding motion of the shaft. The last named mechanism may include a dashpot with a dashpot housing mounted to the shaft and piston supported by the container. A flange projecting outwardly from the dashpot housing slidably engages the internal surface of the container and guides the sliding of the shaft. The housing includes a base member through which the shaft is inserted into the container. An annular collar comprised of two axially split collar sections is assembled around the shaft after the shaft is inserted through the base member. This collar comprises an end member of the container. Also, the collar defines an axial slot which slidably receives an axial elongated key projecting outwardly from the shaft. This key and slot also guides the axial sliding motion of the shaft. The container and shaft, are rotatable about their axis and relative to the housing. A mechanism is provided to selectively lock the container and shaft against such rotation. Also, the shock absorption mechanism may include a coil spring and a spring tension adjustment. The lower end of the shaft comprises a yoke to which a hook is pivoted. The hook includes a body and hook member which mates with the body and is held in place by a keeper.

20 Claims, 4 Drawing Figures

BLOCK

BACKGROUND OF THE INVENTION

This invention relates to an improved block and particularly to such a block for supporting heavy shock imparting loads. For example, to blocks which support oil well drills and drill pipe, and which are used to pull the pipe.

Blocks have heretofore been used to support oil well drills and to pull drill pipe, applications in which the blocks are subject to extreme stress, as well as shock. These blocks are jolted, for example, when drill pipe is picked up and bounces about.

Previously, blocks have included shock absorbers such as springs and oil-filled cylinders and pistons for cushioning purposes.

However, a need exists for an improved block which is rugged, able to withstand heavy loads, and which includes improved means for absorbing shock from supported loads.

SUMMARY OF THE INVENTION

The present invention contemplates a rugged block with a hollow housing within which a cylindrical guideway or container is loosely received and retained against axial motion relative to the housing. A hook supporting shaft is inserted within this guideway and is axially slidable, within predetermined limits, relative to the guideway. A shock absorbing mechanism contained within the guideway dampens the sliding motion of the shaft. This last named mechanism, in the preferred embodiment, includes a coil spring and dashpot. Also, a guide, such as a flange projecting outwardly from the dashpot of housing, slidably couples the shaft to the guideway for guiding axial sliding movement of the shaft. This flange slidably engages the internal surface of the container. In this latter arrangement, the dashpot piston is secured to the container with the guide preventing misalignment of the piston and dashpot housing. This minimizes marring or galling of the dashpot housing by the piston during use.

In addition, the housing includes a base member through which the shaft is inserted into the container. An annular collar comprised of two axially split collar sections is assembled around the shaft following its insertion into the container. This collar closes one end of the container and defines an axial slot which slidably receives a key mounted to the shaft so that the key and slot also guide the axial sliding motion of the shaft. The container collar and shaft are rotatable about their axis and relative to the housing. A means is provided for selectively blocking the container and shaft against such rotation. The lower end of the shaft is adapted to support a hook pivoted thereto. For increased strength, the hook includes a body and hook member which mates with the body and is held in mating engagement by a keeper.

It is an overall object of the invention to provide an improved block, particularly one for use in applications in which the block is subject to shock.

It is still another object of the invention to provide a block of rugged construction, which is reliable and long-lasting.

It is a fur

Still another object of the invention is to provide a block which incorporates an axially slidable shaft and in which the motion of the shaft is guided in an improved manner.

Another object of the invention is to provide a block with shock absorbing components substantially enclosed to minimize their exposure to grit and other abrasive substances.

A further object of the invention is to provide a block which is relatively easy to manufacture.

Still another object of the invention is to provide a block with an improved hook construction.

The subject matter which we regard as our invention is particularly pointed and out and distinctly claimed in the concluding portion of this specification. The invention, however, both as to organization and method of operation, together with further advantages, objects and features thereof, may be best understood with reference to the following description, taken in connection with the following drawings, wherein like reference characters refer to like elements.

DESCRIPTION OF A PREFERRED EMBODIMENT

Figure 1:
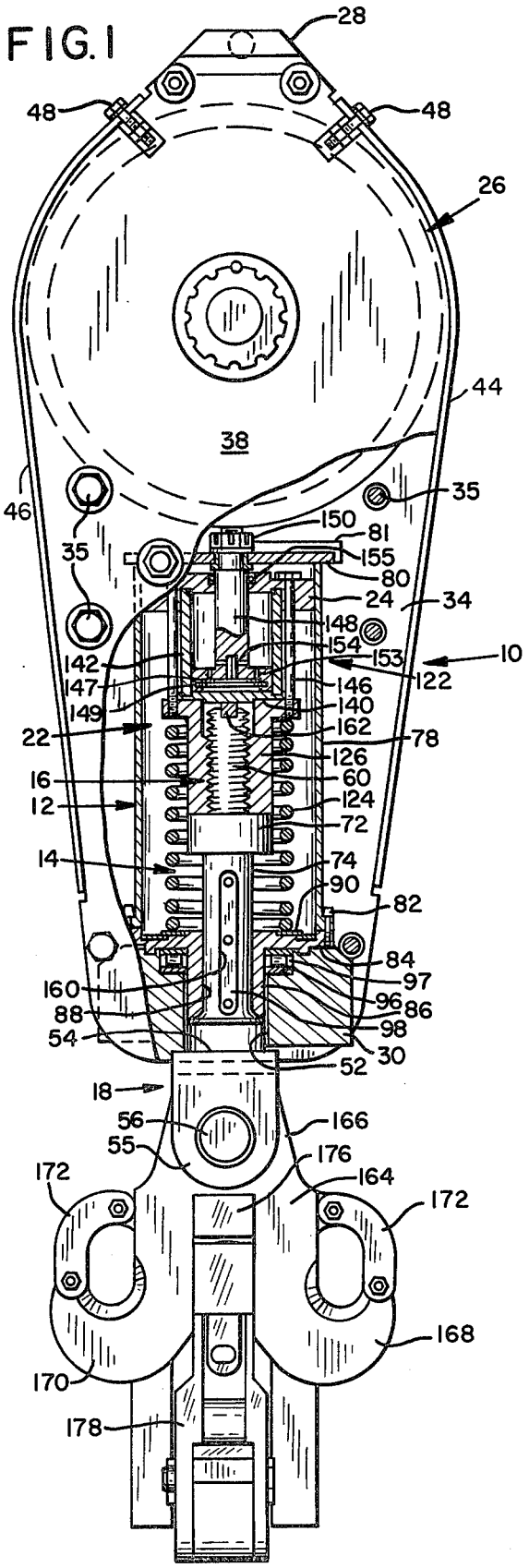
FIG. 1 is a front elevational view of a block of the present invention which is partially broken away and partially in section.
Figure 2:
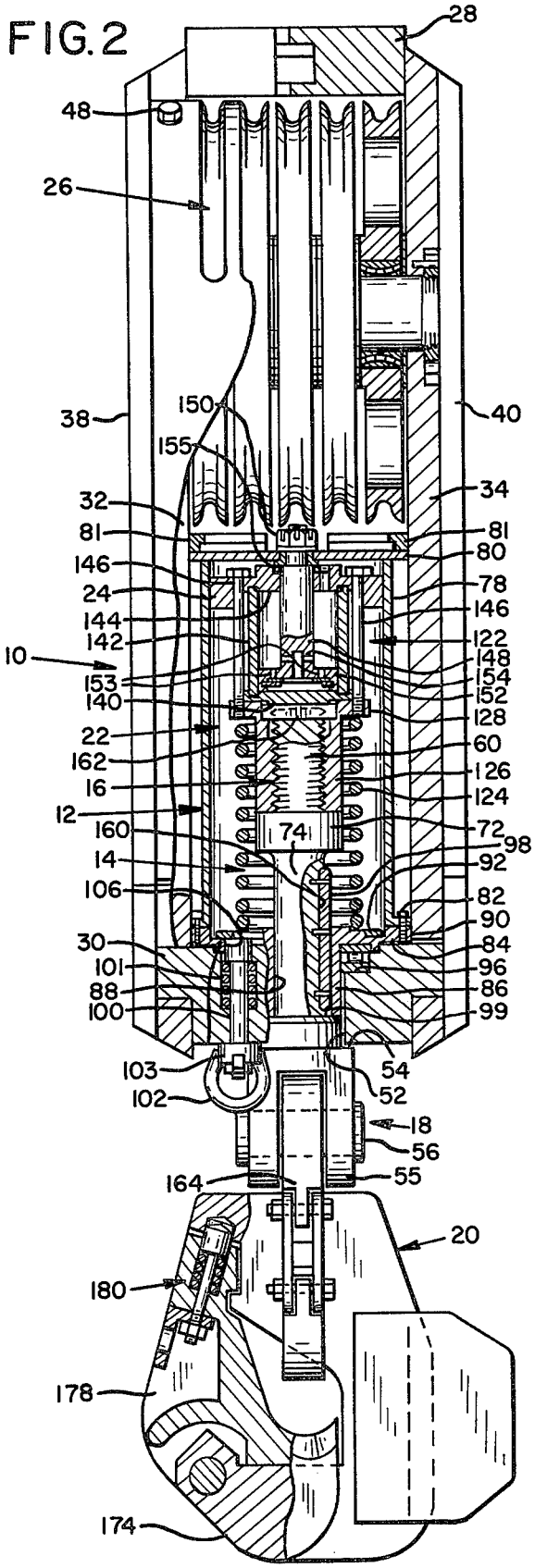
FIG. 2 is a side elevational view of the block of FIG. 1 which is partially broken away and partially in section.

With reference to FIGS. 1 and 2, the block of the invention includes a generally hollow housing 10 which loosely receives a guideway means such as a cylindrical container 12 therein. Container 12 floats loosely within the housing in the sense that there are no rigid connections between the housing and container. Also, container 12 is rotatable relative to the housing although retained against axial shifting as explained below. An elongated shaft 14 is included with a first or upper end 16 inserted into the container 12 and a second or lower end 18, positioned outside the housing, and adapted to support a load carrying hook 20. Shaft 14 is axially slidable relative to housing 10 and container 12. A dampening mechanism 22, positioned within the container, is provided to cushion the sliding motion of the shaft for shock absorbing purposes. A guide means, for example, a flange 24 connected to the shaft 14 as explained below, slidably engages the container 12 to thereby guide the axial motion of the shaft. In addition, plural sheaves 26 are pivoted to the housing for receiving cables which carry the block in a well known manner.

More specifically in regard to the housing 10, the housing includes a cover assembly 28, and a crosshead assembly, or base member 30, which are interconnected by a pair of spaced-apart block sidewall plates 32, 34. Suitable spacers, some shown at 35, establish the spacing between the sidewall plates. In addition, a pair of cheek plates 38, 40 overlie the respective block plates 32, 34. Also, respective faceplates 44, 46 extend between the side edges of the sidewall plates 32, 34 to complete the housing. Conventional sheave locking bolts 48 are mounted to the face plates for selectively engaging the sheaves 26 as desired to prevent them from rotating.

The shaft 14 is preferably of a unitary one piece construction, although not required, and is described as follows. The upper end 16 of shaft 14 is inserted through an aperture 52 of base member 30 and into the container 12. The lower end 18 of shaft 14 is enlarged to form a shoulder 54 with its lower end being of a cross-sectional dimension larger than the cross-sectional dimension of aperture 52. Consequently, shoulder 54 abuts base member 30 and limits the maximum insertion of the shaft into the container. Preferably, enlarged end 18 comprises a yoke 55 to which hook 20 is pivoted by a pin 56. As a result, hook 20 is free to pivot about the axis of this pin while the shaft 14 remains generally stationary and in alignment with the remaining components of the block.

The uppermost tip 60 of shaft end 16 is externally threaded for purposes explained below. In addition, shaft end 16 includes an enlarged stop portion 72 of a cross-sectional dimension less than the cross-sectional dimension of aperture 52. Hence, the stop portion 72 is insertable through the base member 30 aperture and into the container 12. Also a central portion 74 of the shaft 14 is of a reduced cross-sectional dimension relative to the cross-sectional dimension of stop portion 72 for purposes explained below.

Figure 3:
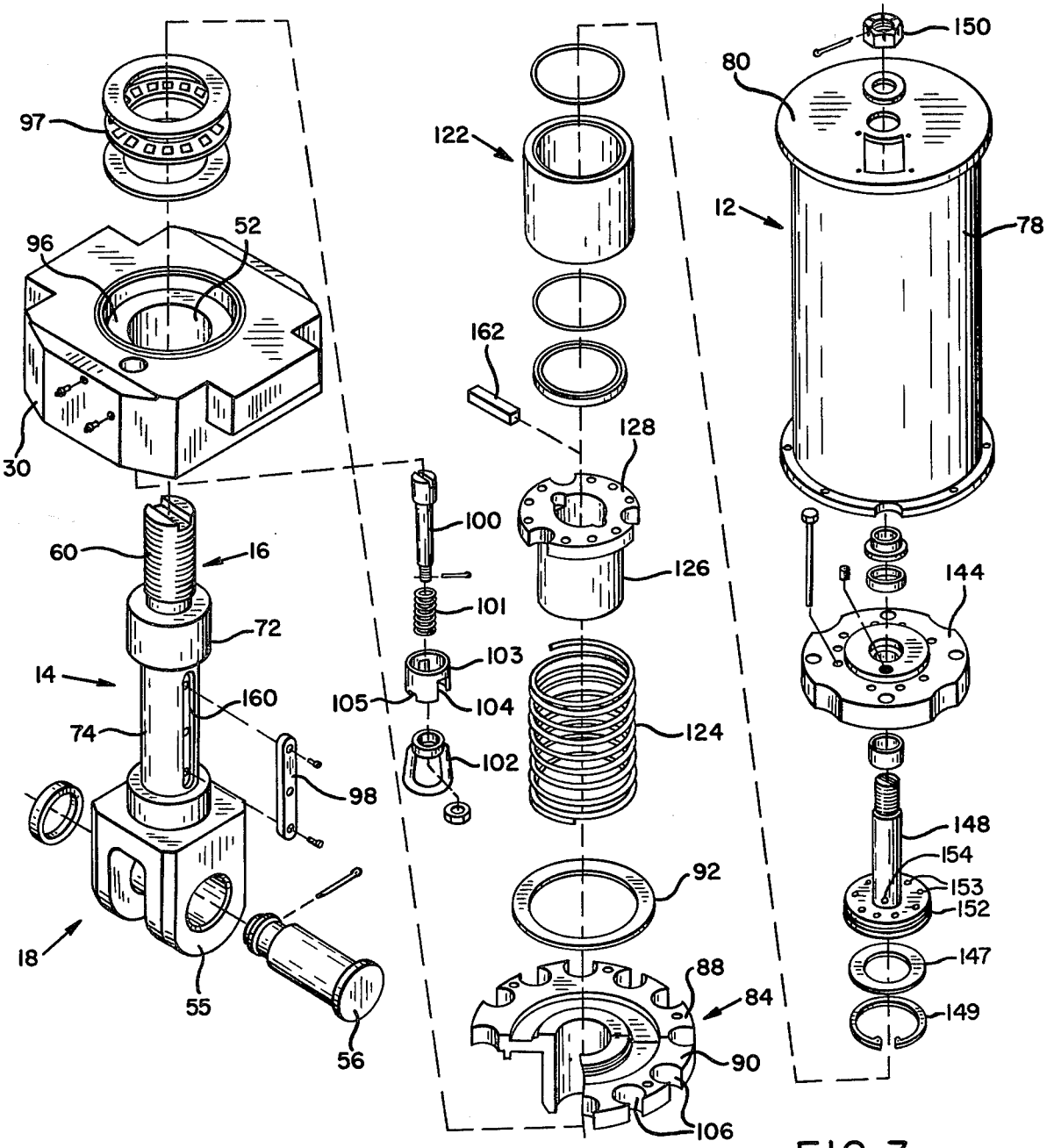
FIG. 3 is an exploded view of a portion of the block of FIG. 1.

As previously mentioned, the block includes a guideway for guiding the sliding of the shaft 14. In the preferred embodiment, this guideway comprises cylindrical container 12 described as follows. Container 12 includes a cylindrical wall 78 closed at the top by a cover or upper end member 80. Wall 78 is connected at the bottom, as by bolts 82, to an annular collar or lower container end member 84. Collar 84 includes a downwardly projecting neck portion 86 which fits snuggly within the aperture 52 when the block is assembled. The collar defines a shaft receiving opening 88 of a dimension less than the cross-sectional dimension of shaft stop portion 72. Thus, the stop portion 72 abuts the collar and prevents removal of the shaft from the block. Preferably, collar 84 is axially split into at least two collar sections 88, 90 (FIG. 3). Hence, following the insertion of shaft 14 through the base member 30, the collar sections are then assembled around the central portion 74 of the shaft with neck 86 within aperture 52. The collar sections are held together by a retaining ring 92. The assembly of these components of the block is explained in greater detail below in connection with FIG. 3. The container 12 is retained in position within the housing by stops 81 mounted to the housing in position to abut cover 80 and prevent axial shifting of the cover. Also, the edges of cover 80 engage the sidewalls 32, 34 of the housing to further position the container. With this construction, the shaft 14 is axially slidable between limits established by shaft end portion 18 and shaft stop portion 72. In addition, the container 12 is loosely retained within the housing.

Collar 84 and housing base member 30 together define a bearing receiving seat 96 within which an annular bearing 97 is positioned. Bearing 97 rotatably couples the collar 84, and hence the container 12 to the housing 10. Also, a means such as a key 98 mounted to the shaft central portion 74 and inserted into an axial slot 99 of the collar 84, couples shaft 14 to collar 84 so as to permit axial sliding of the shaft relative to the collar and prevent relative rotation of these members. As a result, the entire shaft 14, and the container 12, including collar 84, are rotatable relative to the housing.

In addition, a means is provided for selectively preventing the rotation of the shaft 14 and container 12 relative to the housing 10. Such means may include a bolt 100 mounted to the housing base member 30 and biased by a coil spring 101. A ring 102 is mounted to the lower end of the bolt and a spacer 103 is positioned between the under side of base member 30 and the ring. The spacer 103 has a deep slot 104 and a shallow slot 105 (FIG. 3). When the bolt is turned so that the ring 102 is positioned within the deep slot 104, as shown in FIG. 2, bolt 100 is biased by spring 101 into one of plural openings 106 (FIG. 3) provided in collar 84. This locks the collar to the base member and prevents relative rotation of the container 12 and housing 10. In contrast, when the bolt is retracted from opening 106 and rotated to position ring 102 within shallow slot 105, the spacer 103 prevents the bolt from entering an opeing 106. Thus, in this situation the collar, shaft, and container are free to rotate relative to the housing.

As mentioned above, the container 12 includes a dampening mechanism 22 for cushioning the sliding motion of the shaft. Such cushioning means preferably comprises an assembly of a dashpot 122 and spring means such as coil spring 124. More specifically, an internally threaded spring tension adjustment nut 126 is threadedly mounted to the tips 60 of shaft end 16. Tension adjustment nut 126 includes an annular spring retaining flange 128. Spring 124 surrounds the shaft 14 and is positioned between the underside of spring retaining flange 128 and the upper surface of collar 84. Rotation of nut 126 shifts it axially along shaft 14. This moves retaining flange 128 either toward or away from the collar 84 and thereby increases or decreases the tension applied by spring 124 depending upon the direction of travel of the nut along the shaft. Dashpot 122 includes a dashpot housing comprised of a dashpot base 140, a cylindrical dashpot wall 142 and dashpot cover 144. Bolts 146 secure the dashpot housing to the spring retaining flange 128, and hence to the shaft 14. Typically, the dashpot housing is filled with a cushioning fluid such as oil. The dashpot 122 also includes a dashpot piston having a rod 148 secured at its upper end by a nut 150 to container cover 80 and a piston head 152 supported by the free end of the rod within the dashpot housing.

As can be seen from FIGS. 1 and 3, piston head 152 has plural openings 153 through its perimeter as well as openings 154 which communicate from one side of the piston head, through rod 148 to the other side of the piston head. A thin valve 147 is loosely retained to the piston head by a snap ring 149. Although not clear from the drawings, a space is provided between snap ring 149 and the main undersurface of piston head 152. This enables valve 147 to move toward the piston head and close openings 153 where shaft 14 moves upwardly toward the piston. As a result, in such a case, openings 154 meter the passage of oil across the piston head 152, with the size of the openings 154 determining the rate of oil flow and the cushioning provided by the dashpot. In contrast, when shaft 14 slides away from the piston, valve 147 moves away from the piston head and opens the openings 153. This allows more rapid flow of oil across the piston, and hence less cushioning is provided by the dashpot. Of course, spring 124 cushions this downward travel of the shaft. An O-ring seal 155 prevents fluid from leaking from the dashpot housing between the dashpot cover 144 and rod 148.

Hence, the shaft dampening means 22 is virtually completely enclosed within the container 12. This minimizes the exposure of these components to dirt, grit and other abrasive materials which would shorten the life of the block.

As mentioned above, a guide is provided for guiding the axial motion of the shaft. In the preferred embodiment, this guide comprises a projecting flange 24 of the dashpot cover 144. Flange 24 slidably engages the internal surface of the cylindrical wall 78 of container 12. As a result, as the shaft 14 slides, the dashpot piston head 152 is maintained in alignment with the cylindrical dashpot wall 142 so that galling and marring of wall 142 is minimized. The key 98 on the shaft, and key receiving slot 99 in the collar further guide the axial sliding of shaft 14. Also, the dashpot piston may be chrome plated to further minimize galling of dashpot wall 142.

Because of the floating or loose reception of container 12 within the housing 10, the container is free to shift within limits established by the tolerances of the components of the device. As a result, in the event shaft 14 shifts due to play between the shaft and other components, container 12 is permitted to shift a corresponding amount to continuously maintain the dashpot piston 152 in alignment with the cylindrical dashpot housing wall 142 as well as with the shaft. This increases the life and reliability of the block.

The internal components of the block are assembled in the manner explained below in connection with FIG. 3. Key 98 is secured to the central portion 74 of the shaft 14. Central portion 74 includes a recess 160 which accomodates the key. The shaft 14 is inserted through the aperture 52 of base member 30 with roller bearing 97 then positioned in the portion of bearing seat 96 which is defined by the base member 30. Collar sections 88, 90 are then positioned around the central portion 74 of shaft 14 and held in place by ring 92. The spring 124 is placed around the shaft and the retaining nut 126 is mounted to the threaded tip 60 of the shaft. A key 162 keys the nut 126 to shaft 14 so that the nut does not loosen after it has been adjusted to properly tension the spring. The components of the dashpot 122 are then assembled with the cylinder or shroud 12 being connected to the end of the piston rod 148. The container cylinder 78 is then bolted to the collar 84 by the bolts 82.

With reference to FIG. 1, hook 20 includes a tri-lobular body 164 with an upper lobe 166 through which pivot pin 56 is inserted to mount the hook to the shaft 14. The body also includes side lobes 168 and 170 with conventional safety latches 172 bolted between the respective lobes 166, 168 and 166, 170. The hook 20 also includes a hook member 174 which mates with the body 164 and is retained by a keeper 176 secured in place following the mating of the hook member and hook body. Both the hook body and hook member may be forged for strength. A hook closure member 178 is pivoted to hook member 174 for closing the hook after, for example, a load supporting cable is placed on the hook member. A conventional spring loaded latching mechanism 180 is provided to automatically lock the closure member to the hook body and close the hook.

Figure 4:
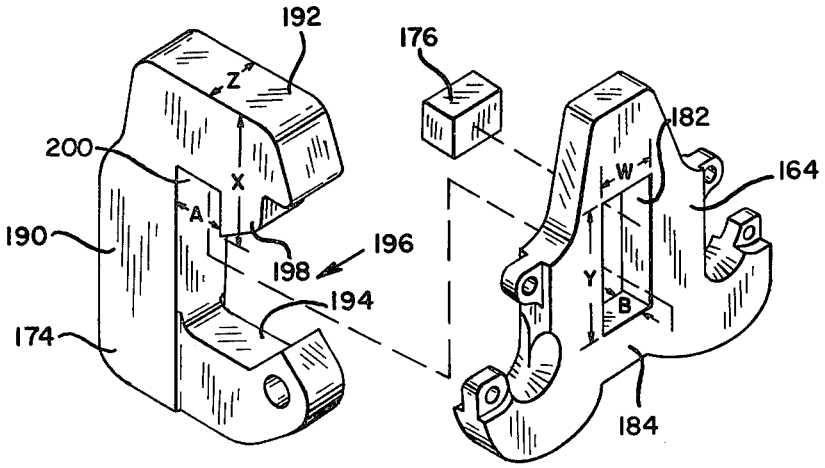
FIG. 4 is an exploded view of a portion of the hook of FIG. 1.

More specifically, with reference to FIG. 4, hook body 164 defines a hook member receiving aperture 182. Hook member 174 is sized for insertion through the aperture 182 with a portion of the hook member positioned along opposite sides of a lower portion 184 of the body which bounds the aperture. Following the insertion of the hook member, a gap or portion of the aperture 182 remains open and is filled by the keeper 176 to retain the hook member and hook body assembled. Keeper 176 is then secured in place, as by welding, to prevent removal of the hook member from the body and thereby provide a strong rigid hook.

In greater detail, the hook member 174 has a back portion 190 and upper and lower jaws 192, 194 which project forwardly from the back portion. The jaws and the back portion together define a mouth 196 which opens through the jaws. A tooth 198 projects downwardly from jaw 192 so that a slot 200 is provided between the back portion 194 and the tooth. The hook member is sized so that the distance X, measured from the tip of the tooth to the upper surface of the upper jaw is less than the height Y of the aperture 182. Also, the width Z of the upper jaw and tooth is less than the width W of the aperture. In addition, the thickness B of the body portion 184 below the aperture is less than the width A of the slot 200. Consequently, the upper jaw is insertable through the aperture and into a position with the body portion 184 within slot 200. Furthermore, when in such a position, a portion of the aperture 182 remains open. The keeper 176 fits within this remaining portion of the aperture and prevents removal of the hook member from the body. As can be seen from FIG. 4, in the preferred embodiment, the hook member is generally "C" shaped, aperture 182 is generally rectangular in cross section, and the upper jaw and tooth are of rectangular cross section as well.

Having described and shown a preferred embodiment of our invention, it will be apparent to those skilled in the art that changes and modifications may be made without departing from my invention in its broadest aspects. We claim as our invention all such modifications as come within the true spirit and scope of the following claims.

I claim:

1. A block comprising:

a hollow housing;

cylindrical guideway means loosely received within said housing;

means for retaining said guideway means loosely within said housing;

an elongated shaft having a first end extending axially into said guideway means and a second end adapted for supporting a hook, said shaft being axially slidable relative to said guideway means;

means for limiting the axial sliding of said shaft within predetermined limits;

biasing means for dampening the sliding motion of said shaft;

guide means slidably coupling said shaft to said guideway means for guiding the sliding of said shaft;

said cylindrical guideway means comprising a container means having a cylindrical wall and first and second end members, the shaft extending through a shaft receiving opening in the second end member and into the interior of the container means;

said guide means comprising means connected to said shaft and positioned within said container means for slidably engaging the internal surface of the cylindrical wall to guide the sliding of said shaft;

and said shaft including a central portion of reduced cross-sectional dimension relative to the cross-section dimensions of adjoining portions of the shaft, the second end member comprising a collar which is split axially into plural collar sections, such collar sections being assembled and positioned to define a shaft receiving opening which surrounds the central portion of the shaft, the shaft receiving opening being of a cross-sectional dimension less than the cross-sectional dimensions of the adjoining portions of the shaft so that said collar retains the shaft within said container means.

2. A block according to claim 1 in which said guide means includes means slideably coupling said shaft to said second end member for guiding the axial sliding of the shaft through the shaft receiving opening.

3. A block according to claim 1 in which said collar defines an axial key receiving slot which has a key receiving opening communicating with the shaft receiving opening, and said shaft includes an axial key which projects outwardly from the central portion of the shaft into the key receiving slot when the collar sections are assembled, so as to guide the sliding of the shaft through the shaft receiving opening.

4. A block according to claim 1 including means for selectively locking said container means against rotation relative to said housing.

5. A block comprising:

a hollow housing;

cylindrical guideway means loosely received within said housing;

means for retaining said guideway means loosely within said housing;

an elongated shaft having a first end extending axially into said guideway means and a second end adapted for supporting a hook, said shaft being axially slidable relative to said guideway means;

means for limiting the axial sliding of said shaft within predetermined limits;

biasing means for dampening the sliding motion of said shaft;

guide means slidably coupling said shaft to said guideway means for guiding the sliding of said shaft;

said cylindrical guideway means comprising a container means having a cylindrical wall and first and second end members, the shaft extending through a shaft receiving opening in the second end member and into the interior of the container means;

said guide means comprising means connected to said shaft and positioned within said container means for slidably engaging the internal surface of the cylindrical wall to guide the sliding of said shaft;

said biasing means comprising dashpot means including a piston mounted to the first end member of said container means and projecting toward said shaft and a dashpot housing coupled to the first end of the shaft and positioned to receive said piston, said guide means comprising a guide flange projecting outwardly from said dashpot housing and into sliding engagement with the internal surface of the cylindrical wall.

6. A block according to claim 5 in which said biasing means includes coil spring means surrounding said shaft, one end of said spring means engaging said shaft and the other end of said spring means engaging said container means so as to dampen the sliding motion of said shaft relative to said container means.

7. A block according to claim 5 in which said first end of the shaft is threaded, said block including a spring tension adjustment means threadedly mounted to said first end of the shaft, said spring tension adjustment means having an outwardly projecting spring retaining flange, said dashpot housing being mounted to said spring retaining flange in a position between said spring retaining flange and the first end member of said container means, said biasing means including coil spring means surrounding said shaft and bearing against said spring retaining flange and the second end member of the housing so as to dampen the sliding motion of said shaft relative to said container means, whereby rotating said spring tensioning adjustment means shifts said spring tensioning adjustment means along the axis of the shaft and thereby adjusts the tension of the spring.

8. A block comprising:

a housing;

said housing including a base member through which an aperture is defined;

a cylindrical container loosely received within said housing, said container having a cylindrical wall, a first end member and a second end member, said second end member comprising an annular collar which includes a cylindrical neck portion positioned within the aperture, and said collar defining a shaft receiving opening;

an elongated shaft with a first end portion positioned within the container and having a cross-sectional dimension which is greater than the cross-sectional dimension of the shaft receiving opening, a central portion of a cross-sectional dimension which is less than the dimension of the shaft receiving opening, and an enlarged load carrying end portion of a cross-sectional dimension which is greater than the cross-sectional dimension of the aperture, said central portion extending through said collar and being of a length greater than the combined axial dimension of the base member and collar, whereby said shaft is slidable relative to the housing and collar and the first end portion of the shaft is retained within the container;

means mounted to said housing for preventing said container from shifting axially;

a spring retainer mounted to the first end portion of said shaft, said spring retainer including an outwardly projecting spring retaining flange;

biasing means for dampening the sliding motion of said shaft, said biasing means including a coil spring which surrounds said shaft with one end of said spring engaging said spring retaining flange and the other end of the spring engaging said collar, said biasing means also including dashpot means comprising a dash pot housing mounted to said spring retainer and projecting away from said base member, said dashpot means including a dashpot piston having a piston head received within the dashpot housing, a piston rod connected to the first end member of the container, and valve means adapted for regulating the flow of cushioning fluid across the piston head; and a guide flange projecting outwardly from said dashpot housing and into sliding engagement with said cylindrical wall so as to guide the axial motion of said shaft.

9. A block according to claim 8 in which said dashpot housing includes a dashpot cover through which the piston rod end extends, said guide flange comprising a projecting portion of said dashpot cover.

10. A block according to claim 8 in which said spring retainer is threadably mounted to the first end portion of the shaft such that rotation of the spring retainer shifts the spring retainer axially along the shaft and thereby adjusts the tension of said spring.

11. A block according to claim 8 in which the neck portion of the collar is provided with an axial key receiving slot, said block including a key mounted to the central portion of the shaft and projecting into the key receiving slot for guiding the axial sliding of the shaft.

12. A block according to claim 8 including plural sheaves pivoted to said housing.

13. A block according to claim 12 in which the load carrying end portion of said shaft comprises a yoke, said block including load carrying hook means pivoted to said yoke.

14. A block according to claim 8 in which said collar is split axially into two collar sections, said collar sections being assembled together to form said collar, said block including means for retaining said collar sections together.

15. A block according to claim 14 in which the shaft is unitary and has a first end portion of a cross-sectional dimension less than the cross-sectional dimension of the aperture so that the first end portion is insertable through the aperture, said collar sections being assembled together and inserted into the aperture to surround the central portion of said shaft following the insertion of said shaft through the aperture.

16. A method of assembling a block comprising:

inserting a first end portion of a shaft through an aperture of a housing base member, the shaft having an enlarged second end portion of a cross-sectional dimension greater than the dimension of the aperture so that the second end portion limits the insertion of the shaft, the shaft also having a central portion of a cross-sectional dimension less than the cross-sectional dimension of the aperture;

assembling and positioning axially-split collar sections following the insertion of the shaft to form a collar which defines an axial shaft receiving opening through which the central portion of the shaft is inserted, the shaft receiving opening being sized to permit sliding of the shaft relative to the collar, the shaft receiving opening also having a cross-sectional dimension which is less than the largest cross-sectional dimension of the first end portion of the shaft so as to prevent retraction of the first end portion of the shaft following its insertion and the assembly of the collar sections;

mounting a biasing mechanism to the shaft for dampening the sliding motion of the shaft;

mounting a shaft sliding guide to the shaft;

connecting a hollow shroud to the collar with the first end portion of the shaft positioned within the shroud and with a wall of the shroud slidably engaging the shaft sliding guide so that the shroud and guide cooperate to guide the sliding motion of the shaft.

17. A method of assembling a block according to claim 16 including the step of keying the collar to the shaft so as to prevent rotation of the shaft relative to the collar while permitting sliding of the shaft relative to the collar.

18. A hook for a block comprising:

a body defining an aperture;

hook member means sized for inserting through the aperture with a portion of said hook member means being disposed along opposite sides of a portion of the body bounding the aperture and with a portion of the aperture remaining open following such insertion;

keeper means for mounting within the remaining open portion of the aperture to retain said hook member means in position; and said hook member means having a back portion and upper and lower jaws which project downwardly from the back portion, the jaws and back portion together defining a mouth which opens through the jaws, said hook member means also including a tooth projecting downwardly from the first jaw, so as to define a slot between the tooth and back portion, said hook member means being sized such that the distance from the lower edge of the tooth to the upper surface of the upper jaw is less than the height of the aperture and such that the distance from one side surface of the upper jaw to the other side surface of the upper jaw is less than the width of the aperture, the body being sized such that the thickness of the body below the aperture is less than the distance between the tooth and back portion, whereby the upper jaw is insertable through the aperture and into a position with the portion of the body below the aperture placed within the slot, and when the upper jaw is placed in this position, a portion of the aperture remains open.

19. A hook according to claim 18 in which said hook member means is generally C-shaped.

20. A hook according to claim 19 in which the aperture is generally rectangular and the upper jaw and tooth are of rectangular cross-section.

* * * * *

UNITED STATES PATENT AND TRADEMARK OFFICE

CERTIFICATE OF CORRECTION

PATENT NO. : 4,466,651

DATED : August 21, 1984

INVENTOR(S) : Michael J. Sowa and Joseph P. Sowa

It is certified that error appears in the above-identified patent and that said Letters Patent are hereby corrected as shown below:

Column 1, line 66, "It is a fur" should be --It is a further object of the invention to provide a block with an improved shock absorbing mechanism.--

Signed and Sealed this

*Ninth* Day of *April 1985*

[SEAL]

*Attest:*

DONALD J. QUIGG

*Attesting Officer*

*Acting Commissioner of Patents and Trademarks*